US010315066B2

(12) United States Patent
Nolz

(10) Patent No.: US 10,315,066 B2
(45) Date of Patent: Jun. 11, 2019

(54) EXERCISE AND SITTING APPARATUS AND METHOD

(71) Applicant: Symbas, LLC, Manchester, IA (US)

(72) Inventor: Jason Nolz, Manchester, IA (US)

(73) Assignee: Symbas, LLC, Manchester, IA (US)

( * ) Notice: Subject to any disclaimer, the term of this patent is extended or adjusted under 35 U.S.C. 154(b) by 0 days.

(21) Appl. No.: 15/247,671

(22) Filed: Aug. 25, 2016

(65) Prior Publication Data

US 2017/0056714 A1 Mar. 2, 2017

Related U.S. Application Data

(60) Provisional application No. 62/283,263, filed on Aug. 25, 2015.

(51) Int. Cl.
*A63B 22/00* (2006.01)
*A63B 21/00* (2006.01)
(Continued)

(52) U.S. Cl.
CPC ..... *A63B 21/4039* (2015.10); *A47C 9/002* (2013.01); *A63B 21/0023* (2013.01); *A63B 21/00047* (2013.01); *A63B 21/00178* (2013.01); *A63B 21/00185* (2013.01); *A63B 21/028* (2013.01); *A63B 21/068* (2013.01); *A63B 21/4033* (2015.10); *A63B 21/4037* (2015.10); *A63B 23/0405* (2013.01); *A61H 7/007* (2013.01); *A61H 2201/0107* (2013.01); *A61H 2201/0192* (2013.01); *A61H 2201/1261* (2013.01); *A61H 2201/1284* (2013.01); *A61H 2201/168* (2013.01); *A61H 2201/1623* (2013.01); *A61H 2201/1628* (2013.01); *A61H 2201/1695* (2013.01); *A61H 2203/045* (2013.01); *A61H 2203/0425* (2013.01); *A61H 2205/088* (2013.01); *A63B 21/0085* (2013.01); *A63B 21/00181* (2013.01); *A63B 23/0205* (2013.01); *A63B 23/0211* (2013.01); *A63B 23/0227* (2013.01); *A63B 23/0482* (2013.01); *A63B 23/1209* (2013.01); *A63B 23/16* (2013.01); *A63B 2208/0204* (2013.01); *A63B 2208/0228* (2013.01);
(Continued)

(58) Field of Classification Search
None
See application file for complete search history.

(56) References Cited

U.S. PATENT DOCUMENTS 3,759,416 A * 9/1973 Constantine ..... B65D 21/0219 206/505
4,416,374 A * 11/1983 Smith ..... B65D 21/045 206/507
(Continued)

*Primary Examiner* — Stephen R Crow
(74) *Attorney, Agent, or Firm* — Shuttleworth & Ingersoll, PLC; Brett Papendick

(57) ABSTRACT

An exercise apparatus comprises a main body with a cavity that can be selectively covered with a lid. The main body is angled to increase the range of motion of a user of the apparatus. At least a portion of the lid is selectively housed within the cavity. A smaller scale embodiment of the exercise apparatus can be utilized as a sitting apparatus that corrects posture while a user is in a seated position. A method of exercise comprises a variety of steps which can be performed by a user while the user remains on his or her back.

14 Claims, 15 Drawing Sheets

(51) Int. Cl.

| | |
|---|---|
| ***A63B 21/002*** | (2006.01) |
| ***A63B 21/068*** | (2006.01) |
| ***A63B 23/04*** | (2006.01) |
| ***A47C 9/00*** | (2006.01) |
| ***A63B 21/02*** | (2006.01) |
| *A61H 7/00* | (2006.01) |
| *A63B 23/02* | (2006.01) |
| *A63B 23/12* | (2006.01) |
| *A63B 21/008* | (2006.01) |
| *A63B 23/16* | (2006.01) |

(52) U.S. Cl.

CPC ..... *A63B 2208/0242* (2013.01); *A63B 2208/0252* (2013.01); *A63B 2209/00* (2013.01); *A63B 2209/14* (2013.01); *A63B 2225/093* (2013.01)

(56) References Cited

U.S. PATENT DOCUMENTS 5,127,647 A * 7/1992 Wilkinson ..... A63B 23/0458 108/12
5,162,028 A * 11/1992 Wilkinson ..... A63B 23/0458 108/65
5,354,247 A * 10/1994 Wilkinson ..... A47C 3/20 206/505
5,540,638 A * 7/1996 Wilkinson ..... A47C 3/20 482/51
5,651,753 A * 7/1997 Wilkinson ..... A63B 23/0458 482/51
7,922,623 B2 * 4/2011 Flentye ..... A63B 23/0458 482/142
7,943,888 B2 * 5/2011 Barnes ..... H05B 1/0266 219/432
8,348,812 B2 * 1/2013 Elpers ..... A63B 23/0458 482/142
8,640,487 B2 * 2/2014 Chapa ..... F25D 3/08 206/504
9,352,877 B2 * 5/2016 Furlong ..... A47J 47/10
2003/0136699 A1 * 7/2003 McNeeley ..... B65D 21/02 206/518
2005/0029259 A1 * 2/2005 Famham ..... A47G 19/025 220/4.27
2006/0179568 A1 * 8/2006 Campbell ..... A47D 7/007 5/93.1
2007/0187277 A1 * 8/2007 Furlong ..... B65D 21/022 206/515
2010/0263328 A1 * 10/2010 Dorsey ..... B65D 43/0218 53/432
2012/0202652 A1 * 8/2012 Ross ..... A63B 23/0458 482/52
2012/0318697 A1 * 12/2012 Stern ..... B65D 21/0233 206/514
2013/0140211 A1 * 6/2013 Robbins, III ..... A45F 3/20 206/517
2013/0140311 A1 * 6/2013 Roy ..... B65D 41/16 220/270
2015/0041460 A1 * 2/2015 Owen ..... B65D 81/3453 219/734
2016/0194112 A1 * 7/2016 Dziaba ..... B65D 21/0219 206/505
2017/0253378 A1 * 9/2017 Barre ..... B65D 21/0233

* cited by examiner

EXERCISE AND SITTING APPARATUS AND METHOD

CROSS REFERENCE TO RELATED APPLICATIONS

This application claims priority from provisional patent application Ser. No. 62/283,263, filed Aug. 25, 2015. The disclosure of said provisional patent application serial is hereby incorporated in its entirety.

BACKGROUND

Many types of exercise regiments and methods exist both with and without the use of equipment. A person exercising while on his back can typically raise his knees to approximately one-hundred and ten degrees which is considered a normal range of motion (ROM) for hip flexion. By elevating the lower half of the person, the angle can be increased. Certain known exercise devices have deficiencies in that they impair ROM and/or do not support the thoracic region and spine. Due in part to the complexity of the hip joint, as it has seventeen muscles crossing it along with six different actions, the imbalance of the muscles is likely. Furthermore, the hips, shoulders and arms are working muscles in planes of motion that do not have a mechanical advantage. An angle of at least ninety degrees of flexion is needed for the hip and shoulder not to have such an advantage. While there are several exercises for the shoulder, there is no current method for the hips.

Similarly, research has shown that persons sitting for extended periods of time can develop inappropriate posture and health issues. The use of computers in the workplace has only increased the amounts of times people spend in a seated position. By supporting the spine while sitting, a more appropriate posture can be maintained. Current wedges or pillows do not properly support certain anatomical structures while a user is sitting on a floor or chair.

BRIEF SUMMARY OF THE INVENTION

The present invention presents an exercise apparatus that can be utilized to increase range of motion while properly supporting the thoracic region and spine. A smaller version of the exercise apparatus can be used to improve posture while sitting. Additionally, a method of exercise is detailed that can be accomplished while using the exercise apparatus.

The exercise apparatus utilizes a main body with a cavity that house a portion of a lid. The shape of the main body is such that a base of the main body has a larger surface area than a top of the main body. Accordingly, the shape corresponds to a pyramidal or cylindrical shape. The lid has a similar shape but is reversed. The portion of the lid can be housed within the cavity or flipped over and rested on top of the main body allowing for additional uses and exercises.

Similarly, the sitting apparatus has similar structures but at a smaller scale. The sitting apparatus has a main body that is in front of the user's buttocks while in a seated position. A lid of the sitting apparatus can be removed which reveals the cavity of the main body. If a male user of the sitting apparatus, the cavity can accommodate the testicles and allows for a greater degree of comfort.

The method associated with the exercise apparatus is based on the increased ROM allowed by the exercise apparatus itself. As the follower of the method which utilizes the exercise apparatus is on his or her back, the chances of falling or twisting an ankle is practically zero. Furthermore, the user's body resistance dictates pressure and little physical space is needed to perform the exercise method.

The user places a first portion of his back on a floor surface and a second portion of his back, the lower back, on a first side of the exercise apparatus. The first side is sloped and the position of the use is such that the user's buttocks is on the flat portion of the lid of the exercise apparatus. The slope elevates the lower half of the thoracic spine and upper lumbar spine typically between five and twelve inches. The weight of the legs and knees while in this elevated position allows the legs and knees to be pulled toward the chest of the user. This position creates lumbar and hip flexion, further allowing the knees to be adjacent to the thorax in a passive motion which would not be possible without the support provided by the exercise apparatus.

While in the elevated position, a user can use his hands in front of his knees or thighs and can perform a variety of body weighted exercises by pushing against the knees. While parts of the body resist the movement of the knees, a force by the user overcomes the body weighted resistance and the knee can be lifted into the air or moved in an arc toward the floor surface. The preferred exercise method utilizes a single hand position at or about the knee, however, other hand positions on the lower body can be utilized and are detailed in this application. The elevated position allows for a greater range of motion and the muscles and joints are at maximum flexion and a ninety degree extension. This is true for both the elbow joint and the hip joint, and no other exercise machine can match the degree of flexion allowed by the exercise apparatus. Other specific exercises done with the exercise apparatus are described in greater detail in the detailed description section of this application.

The use of gravity while in the elevated position assists the user to bring his thighs and knees closer to the torso while the elevated position of parts of the body allows the glenohumeral joint and the acetabular femur joint to travel in every plane of motion, flexion, extension, internal rotation, adduction, abduction and circumduction. These planes and ranges of motions are not possible by just lying on the floor, and furthermore these ranges of motion are not possible by using a current state of the art wedge, as the wedge does not possess the aspects of the invention described herein. Additionally, standard wedges would not maintain the position of the user, and therefore, the user would slide down off the wedge onto the floor without an elevated level surface.

BRIEF DESCRIPTION OF THE SEVERAL VIEWS OF THE DRAWING(S)

DETAILED DESCRIPTION OF THE INVENTION

Figure 1:
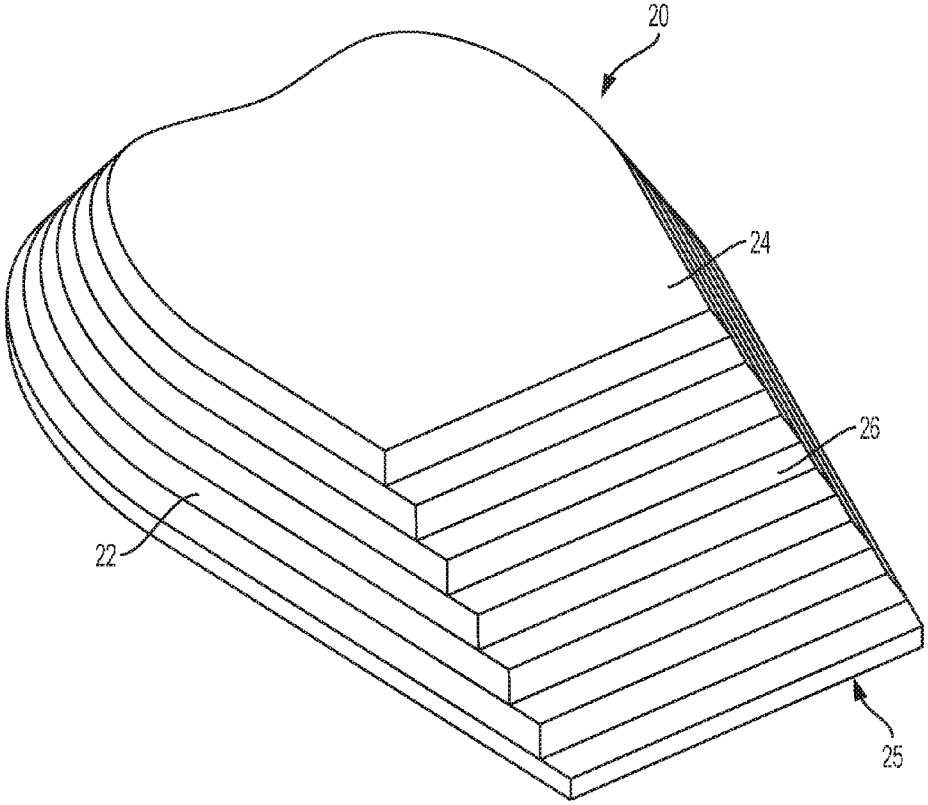
FIG. 1 is a perspective of an exercise apparatus.
Figure 2:
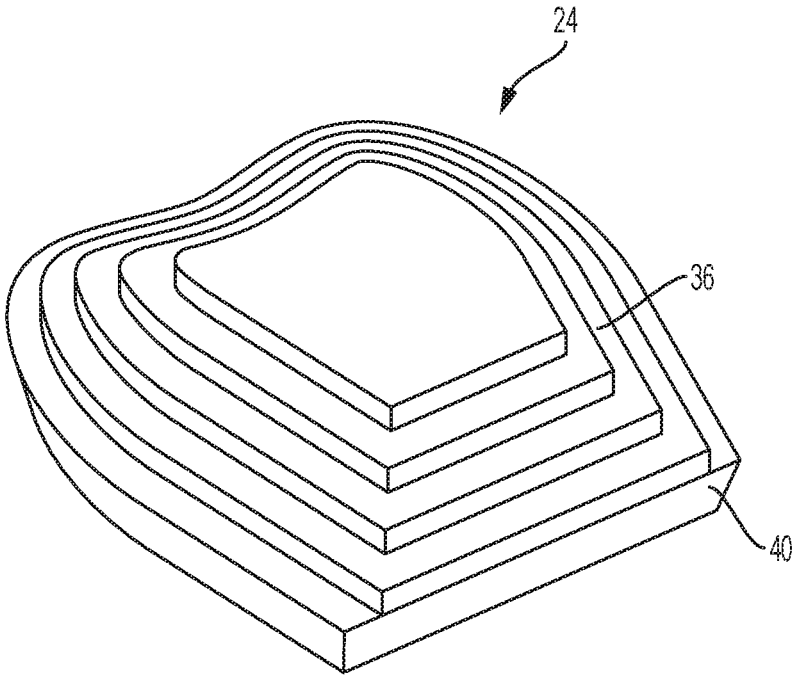
FIG. 2 is a perspective of a lid of the exercise apparatus.

FIGS. 1-6 illustrate a first embodiment of an exercise apparatus 20. The apparatus comprises a main body 22 and a lid 24. The main body 22 is comprised of at least one layer 26, and in the preferred embodiment the main body 22 comprises a plurality of layers 26 with a flat base 25. The layers 26 of the main body 22 are such that a bottom layer 27 is larger than a top layer 29. Accordingly, the layers 26 form an exterior portion 30 that has a shape that is similar to a pyramid or a conical type shape. A first side 23 of the main body 22 forms an angle relative to a floor surface, and in the preferred embodiment, the angle is between twenty and forty-five degrees, with twenty-five being considered ideal. A second side 27 of the main body 22 forms an angle relative to the floor surface, and in the preferred embodiment, the angle is between fifty and seventy-five degrees, with seventy-five being considered ideal.

Figure 3:
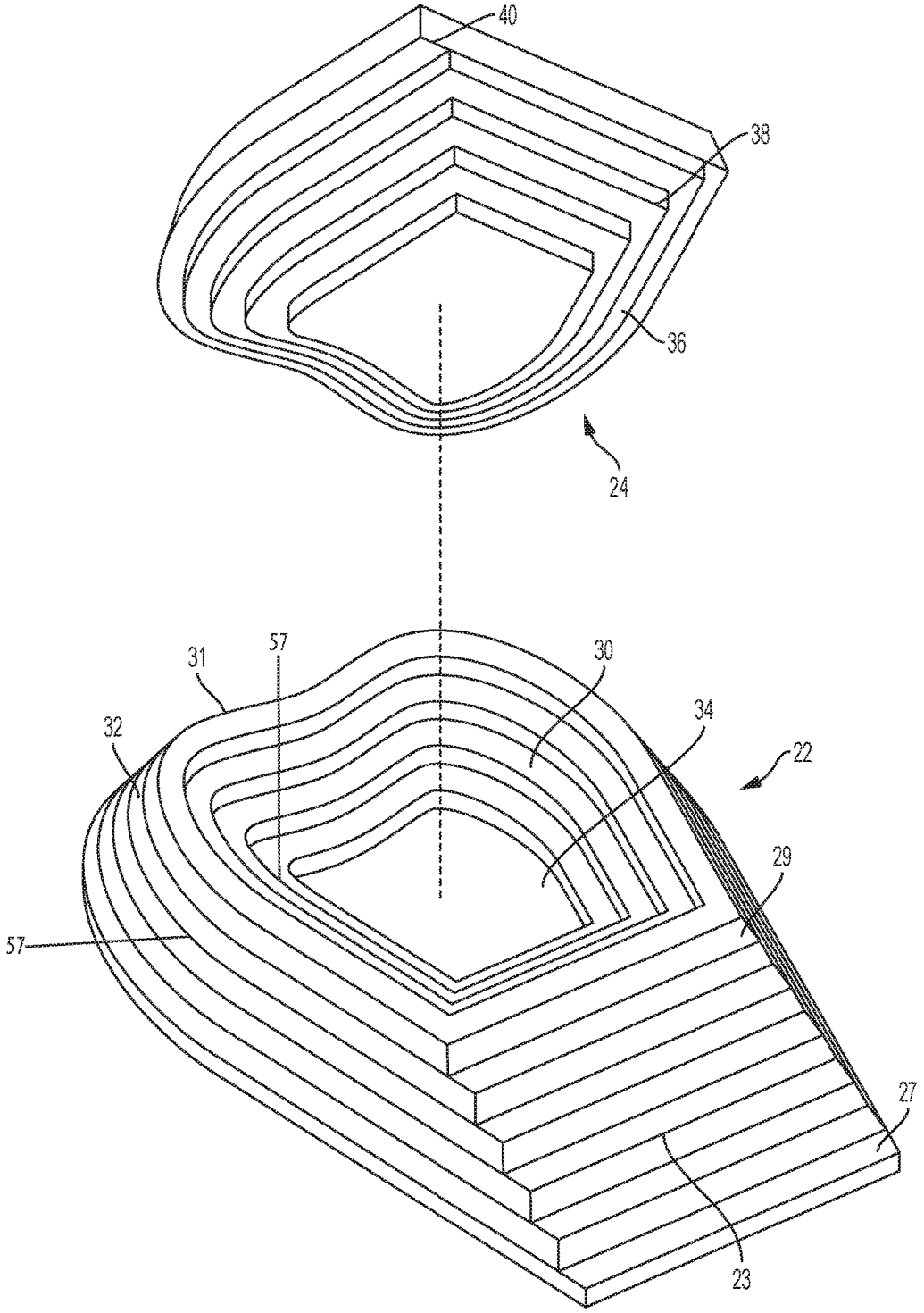
FIG. 3 is an exploded view of a main body and the lid.
Figure 4:
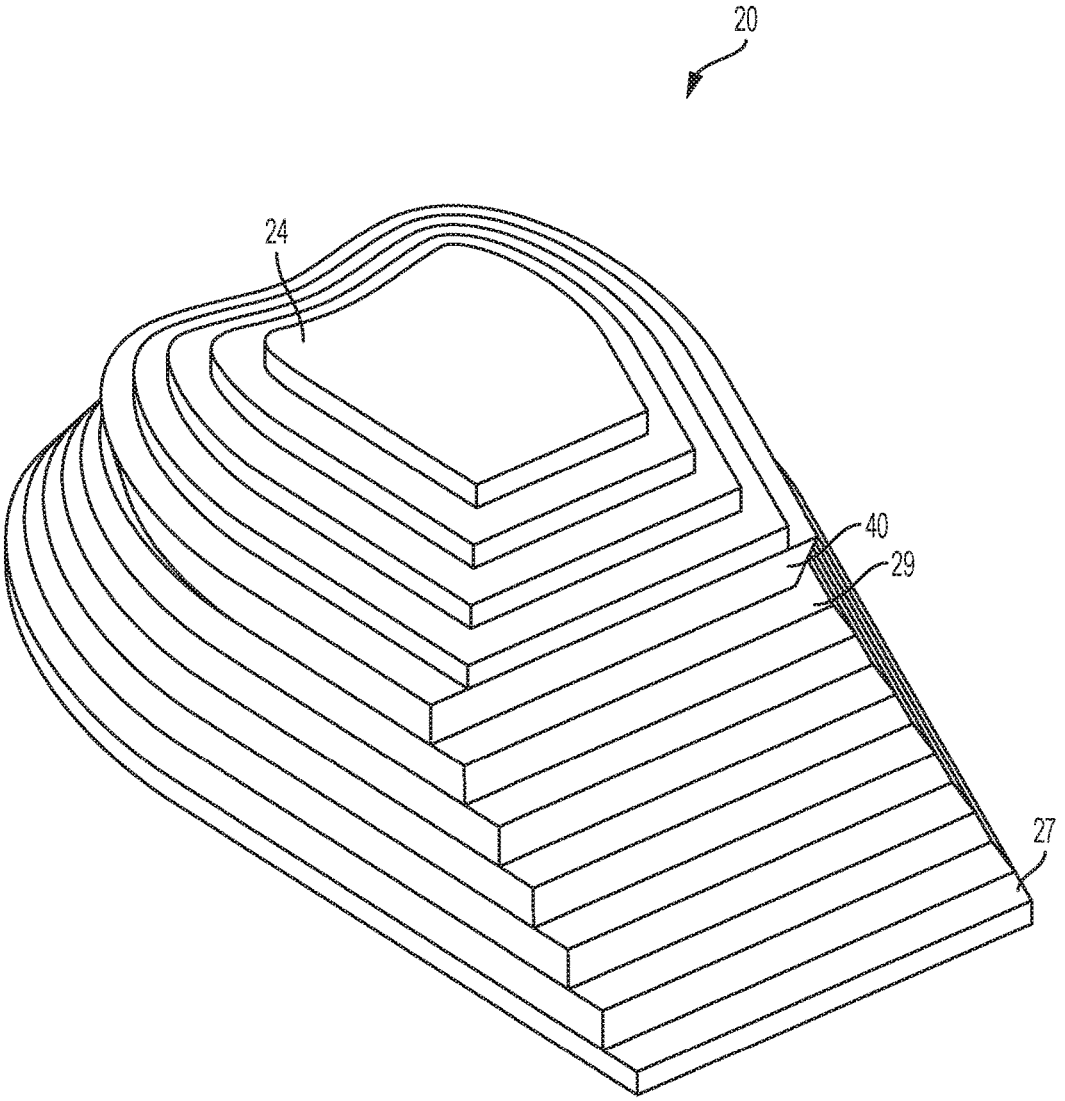
FIG. 4 is a perspective view of the exercise apparatus with the lid inverted on the main body.
Figure 5:
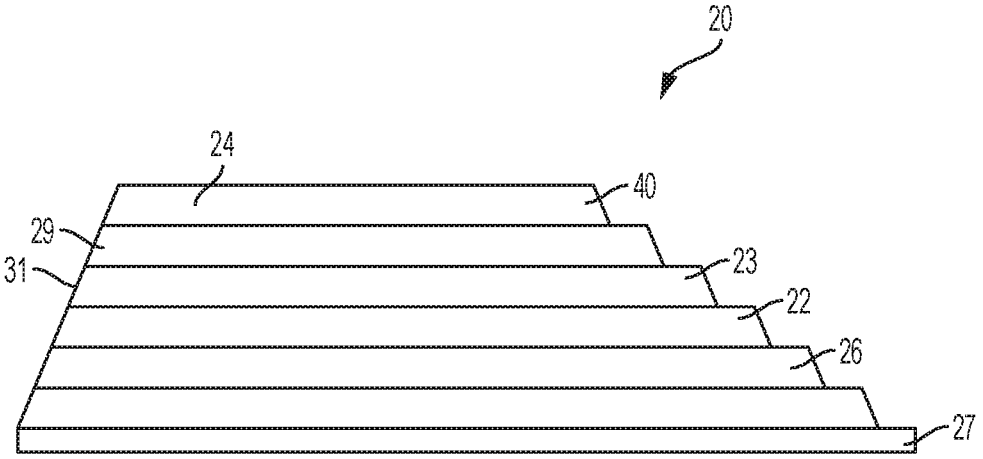
FIG. 5 is a side view of the exercise apparatus.
Figure 6:
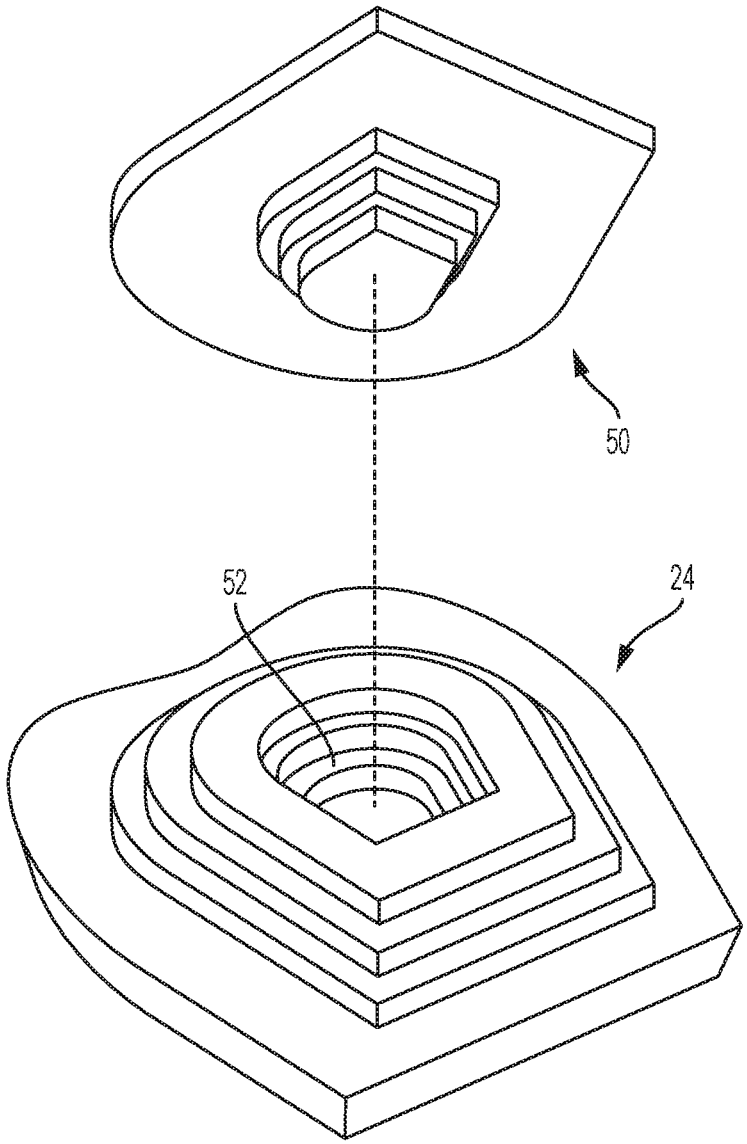
FIG. 6 is a perspective view of the exercise apparatus showing the second lid.

In FIG. 3, an interior portion 30 of the main body 22 is shown that has an inverse shape of the exterior portion 32. The interior portion 30 forms a cavity 34 that can selectively house at least a portion of the lid 24.

The lid 24 has an exterior 36 with a shape corresponding to the interior portion 30 of the main body. Accordingly, the lid 24 is preferably made of multiple layers 38 that are selectively housed in the cavity 34. The lid 24 further comprises a cover 40.

In the preferred embodiment, the main body 22 and the lid 24 are made of a foam material that is dense enough to support the weight of a user. Furthermore, the layers 26 of the main body 22 and the layers 38 of the lid 24 are joined together, however, air movement to and from the cavity 34 and the outside of the exercise apparatus 20 can still occur between the layers 26 and/or layers 38 as the preferred embodiment does not entirely bond one layer to an adjacent layer. These attributes allow the exercise apparatus 20 to support the body weight of a user either in a sitting or standing position. Additionally, although the exercise apparatus 20 will bend due to the inherent flexibility of the main body 22 and the lid 24, the exercise apparatus 20 will rebound to its original shape once whatever force generated by the user has ceased.

Figure 7:
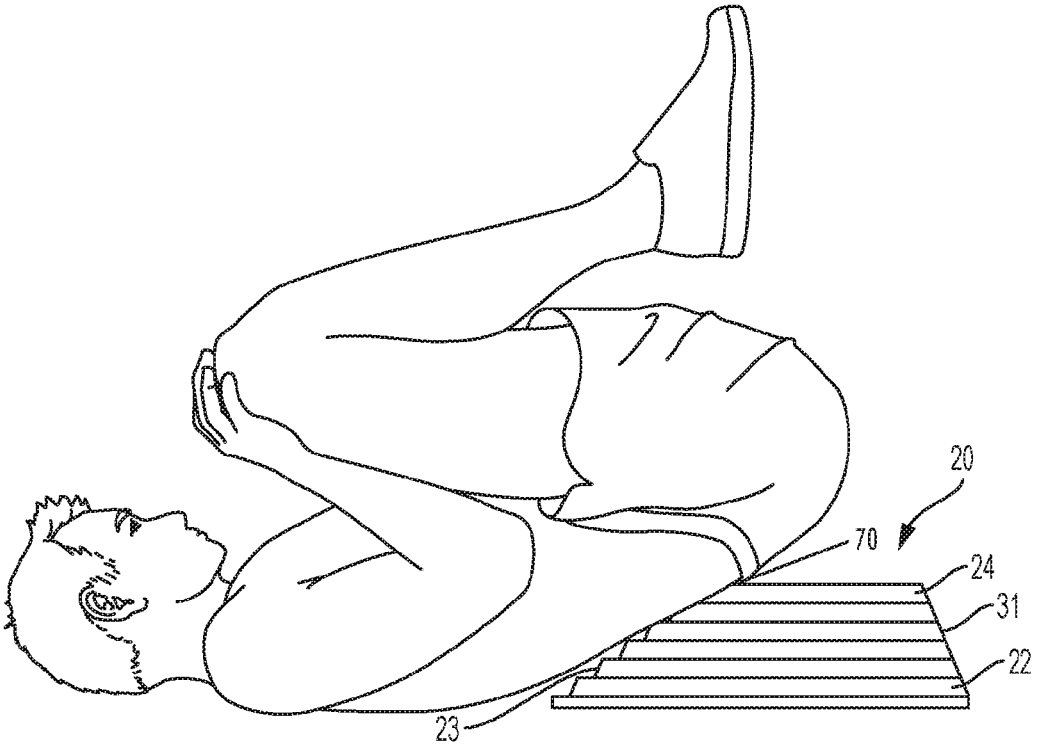
FIG. 7 is a side view of a person using the exercise apparatus.
Figure 8:
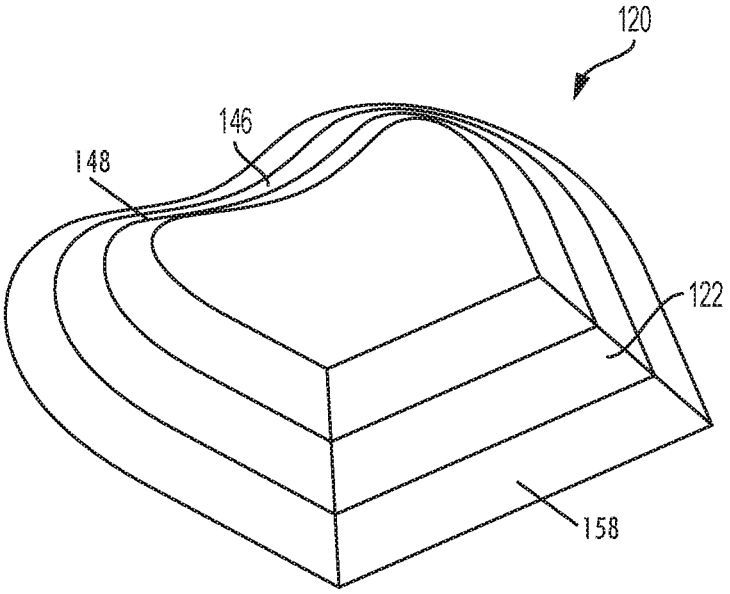
FIG. 8 is a perspective of the sitting apparatus.
Figure 9:
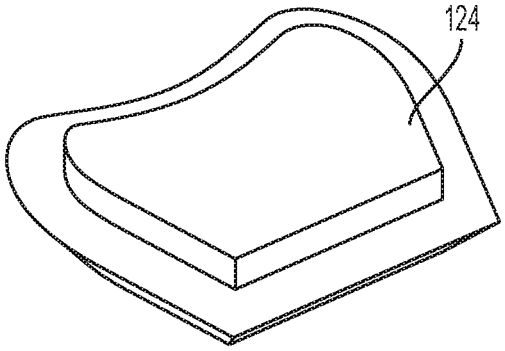
FIG. 9 is a perspective of a lid of the sitting apparatus.

As shown in FIG. 7, in use, a user of the exercise apparatus can lie on his or her back such that the majority of the user's back, particularly the middle to upper portion of the back is on the floor surface, while the lower portion of back is on the first side 23 of the main body 22. The user's buttocks and even part of the lower portion of the back will rest on top of the lid 24. The position shown in FIG. 7 shows the legs passively bent to the abdomen. The angle and elevation created by the exercise apparatus on the user allows gravity to aid in the passiveness of the legs toward the abdomen as well as allow a greater range of hip flexion. A person lying on the floor without the exercise apparatus experiences the hip flexors struggling to maintain the knees in a raised position due to the weight of the legs and thighs.

As shown in FIG. 7, one exercise entails the abdominal muscles and hip flexors resisting as the triceps are pushing. As the buttocks approach the level surface of the exercise apparatus 20, the lumbar spine curves. The amount of curvature created in the lumbar spine is dictated by a front corner 70 of the exercise apparatus 20 which forces the back into extension and causes the rectus abdominus to lengthen.

As the user does one or more of the exercises described in greater detail below, the user will have a greater range of motion than one would have by simply laying on a floor surface. As force is generated by the user on the exercise apparatus 20, the lid 24 can be pushed downward into the cavity 34. The exterior cavity 34 can be pushed outward which allows the user's body to move laterally due in part to the flexibility and instability of the exercise apparatus 20, particularly if the second lid 50 is removed. Air is pushed out between the layers 26 and 38. The amount of air that is pushed out is dependent on the force of the user and whether the second lid 50 is removed. Accordingly, the compression force the user exerts on the lid 24 can be varied during the exercises and can also allow users of varying weights to utilize the exercise apparatus 20. In an embodiment wherein the main body is one solid piece instead of layers, a series of air channels 57 or tubing can be utilized to allow air flow, or these air channels 57 can be added to a layered embodiment as well.

A user of the exercise apparatus 20 can also invert the lid 24 and place it on the top layer 29 of the main body 22. The cover 40 is now touching the top layer 24. As the cover 40 is a larger surface area than a top of the cavity 34, the cover 40 will compress into the cavity 34 during use, but will again rebound to its position after the force is released. A user of the exercise apparatus 20 in this configuration will be provided greater elevation and increase the height of the user's lower body. This allows for additional exercises to be done, including neck exercises. Furthermore, the lid 24 can be utilized independently without the main body 22 in certain exercises. A user can fill the cavity 34 with spacers (not shown) to create a convex shape once the lid 24 is placed back upon the main body 22. Additionally, the user could invert the entire exercise apparatus 20 in this mode and sit on the bottom of the main body 22.

Similarly, a user of the exercise apparatus 20 can remove the lid 24 and place the main body 22 on the floor. The user then sits such that user's buttocks are contained in the cavity 34. This allows a user to do sit-ups while being supported by the main body 20. Furthermore, depending on whether the user is facing the first side 23 or second side 31, the user is provided either a twenty to forty-five degree angle of extension or a fifty to seventy-five degree angle of extension, respectively. Furthermore, an exercise ball can be placed in the cavity 34 of the main body 22 if the lid 24 is removed.

The above description is for a two part exercise apparatus with the two parts being the main body 22 and the lid 24. A third part can be added which is a second lid 50. In the three part embodiment, the lid 24 has a cavity 52 which selectively houses the second lid 50 in the same way the cavity 34 selectively houses the lid 24. The second lid 50 can also be utilized a sitting device as described below. A user can also remove the second lid 50 and replace the lid 24 back into the cavity 34 of the main body 22. This allows the lid 24 to sink into the cavity 34 and provide more of a cushioning effect if a user chooses to sit in a middle of the lid 24.

FIGS. 8-11 show a first embodiment of a sitting apparatus 120 and FIGS. 12-15 show a second embodiment of the sitting apparatus 220. The apparatuses have similar structures but vary on the number of layers and the depth of the cavity. Furthermore, the structural components of the sitting apparatuses are similar to that of the exercise apparatus 20, but in a smaller scale.

The first embodiment of the sitting apparatus 120 comprises a main body 122 and a lid 124. The main body 122 is comprised of at least one layer 126, and in the preferred embodiment the main body 122 comprises a plurality of layers 126 with a flat base 125. The layers 126 of the main body 122 are such that a bottom layer 127 is larger than a top layer 129. Accordingly, the layers 126 form an exterior portion 130 that has a shape that is similar to a pyramid or a conical type shape. A first side 123 of the main body 122 forms an angle relative to a floor surface, and in the preferred embodiment, the angle is between twenty and forty-five degrees.

Figure 10:
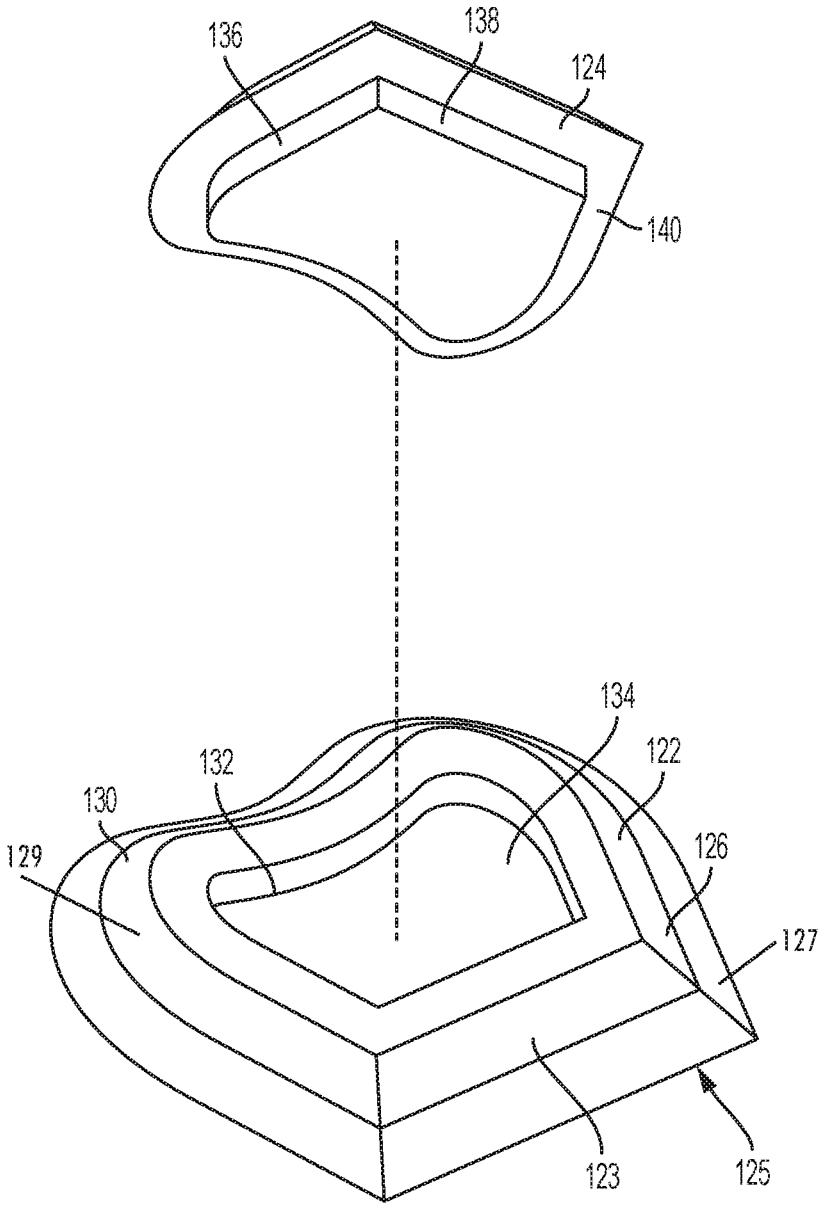
FIG. 10 is an exploded view of a main body and the lid.
Figure 11:
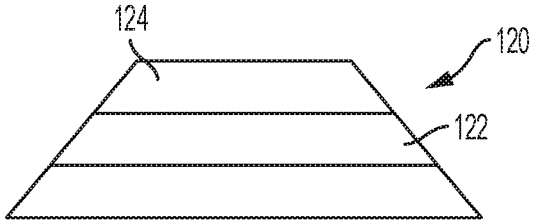
FIG. 11 is a side view of the sitting apparatus.
Figure 12:
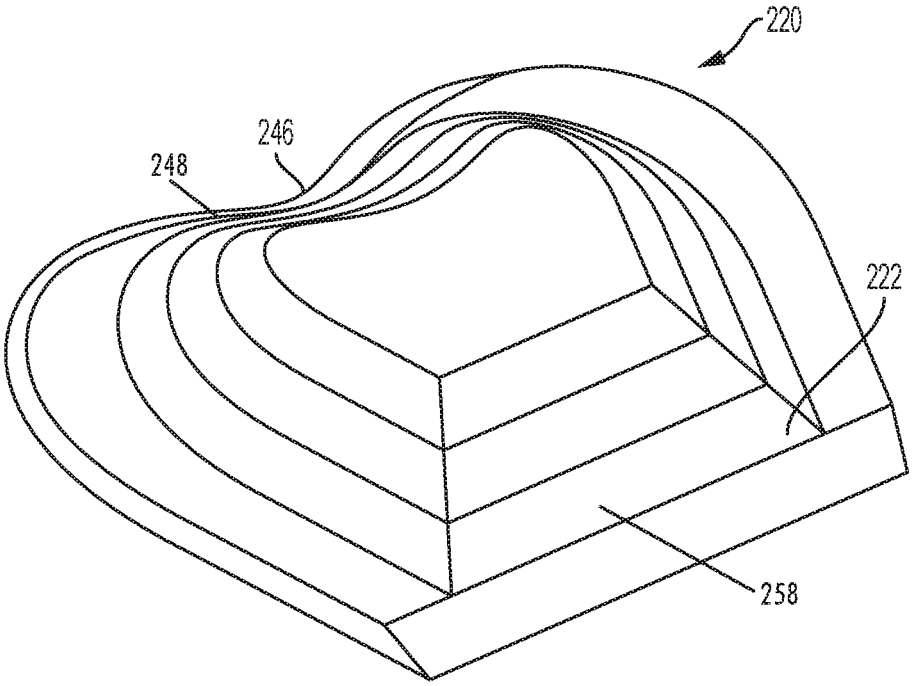
FIG. 12 is a perspective view of a second embodiment of a sitting apparatus.
Figure 13:
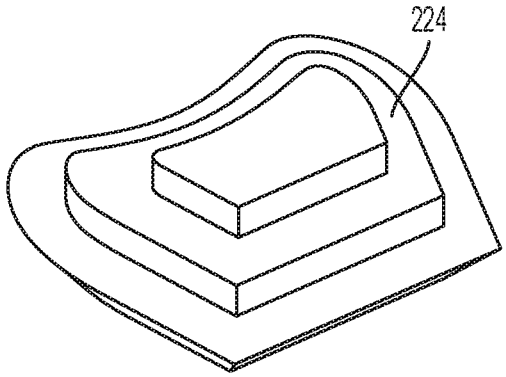
FIG. 13 is a perspective view of the lid of the second embodiment of the sitting apparatus.

In FIG. 10, an interior portion 130 of the main body 122 is shown that has an inverse shape of the exterior portion 132. The interior portion 130 forms a cavity 134 that can selectively house at least a portion of the lid 124.

The lid 124 has an exterior 136 with a shape corresponding to the interior portion 130 of the main body. Accordingly, the lid 124 is preferably made of multiple layers 138 that are selectively housed in the cavity 134. The lid 124 further comprises a cover 140.

In the preferred embodiment, the main body 122 and the lid 124 are made of a foam material that is dense enough to support the weight of a user. Furthermore, the layers 126 of the main body 122 and the layers 138 of the lid 124 are joined together, however, air movement to and from the cavity 134 and the outside of the sitting apparatus 120 can still occur between the layers 226 and/or layers 138. These attributes allow the sitting apparatus 120 to support the body weight of a user. Additionally, although the sitting apparatus 120 will bend due to the inherent flexibility of the main body 122 and the lid 124, the sitting apparatus 120 will rebound to its original shape once whatever force generated by the user has ceased.

The second embodiment of the sitting apparatus 220 comprises a main body 222 and a lid 224. The main body 222 is comprised of at least one layer 226, and in the preferred embodiment the main body 222 comprises a plurality of layers 226 with a flat base 225. The layers 226 of the main body 222 are such that a bottom layer 227 is larger than a top layer 229. Accordingly, the layers 226 form an exterior portion 230 that has a shape that is similar to a pyramid or a conical type shape. A first side 223 of the main body 222 forms an angle relative to a floor surface, and in the preferred embodiment, the angle is between twenty and forty-five degrees.

Figure 14:
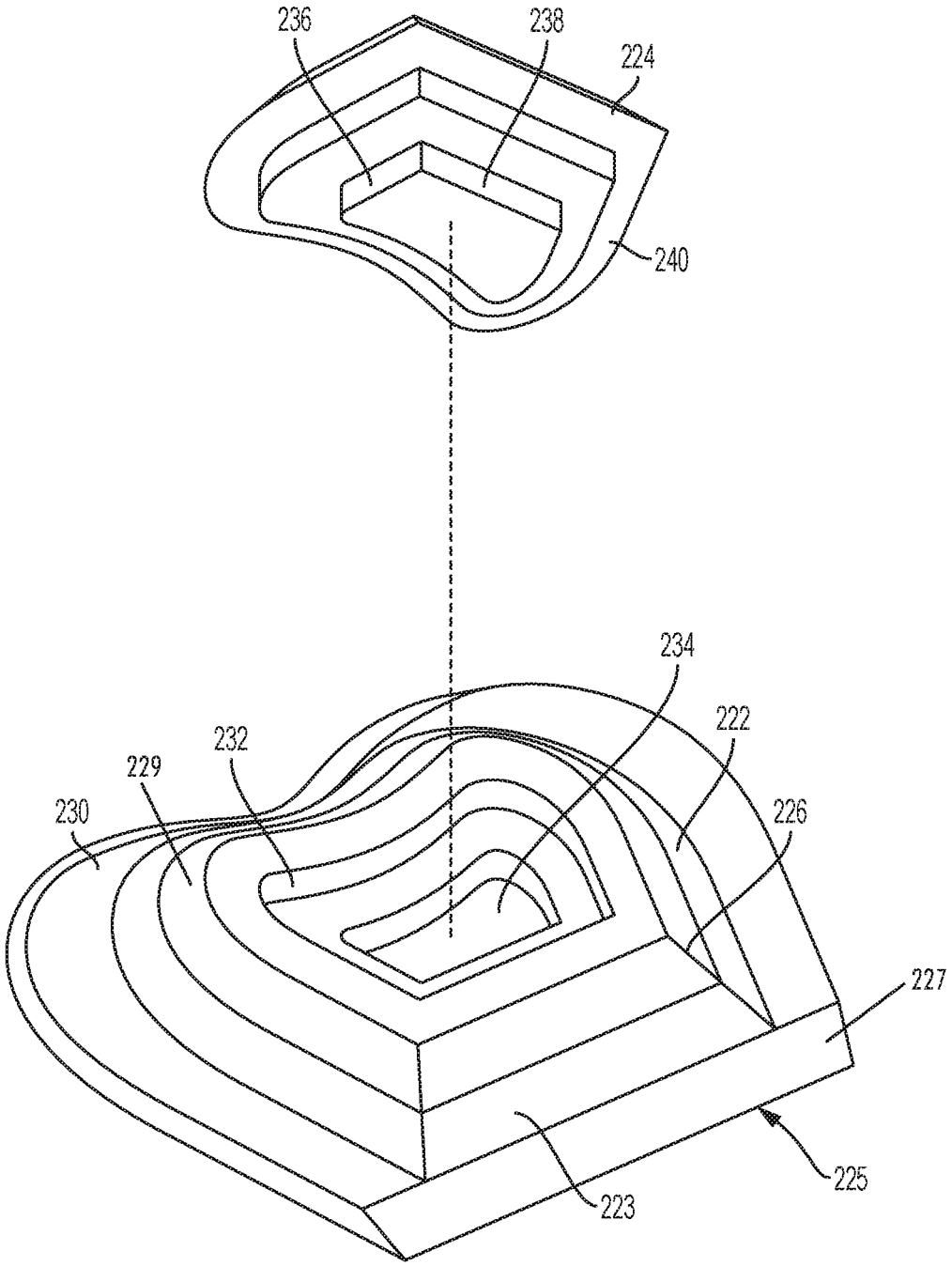
FIG. 14 is an exploded view of the second embodiment of the sitting apparatus.
Figure 15:
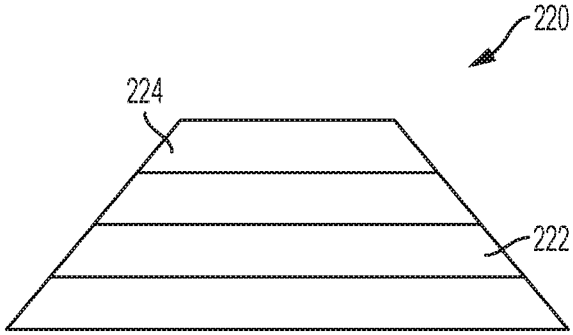
FIG. 15 is a side view of the second embodiment of the sitting apparatus.

In FIG. 14, an interior portion 230 of the main body 222 is shown that has an inverse shape of the exterior portion 232. The interior portion 230 forms a cavity 234 that can selectively house at least a portion of the lid 224.

The lid 224 has an exterior 236 with a shape corresponding to the interior portion 230 of the main body. Accordingly, the lid 224 is preferably made of multiple layers 238 that are selectively housed in the cavity 234. The lid 224 further comprises a cover 240.

In the preferred embodiment, the main body 222 and the lid 224 are made of a foam material that is dense enough to support the weight of a user. Furthermore, the layers 226 of the main body 222 and the layers 238 of the lid 224 are joined together, however, air movement to and from the cavity 234 and the outside of the sitting apparatus 220 can still occur between the layers 226 and/or layers 238. These attributes allow the sitting apparatus 220 to support the body weight of a user. Additionally, although the sitting apparatus 220 will bend due to the inherent flexibility of the main body 222 and the lid 224, the sitting apparatus 220 will rebound to its original shape once whatever force generated by the user has ceased.

The sitting apparatuses 120 and 220 can be used with or without the lids 124 and 224 respectively. A user sits on the apparatus 120 or 220 and the apparatus serves as a pelvic guide that contacts a sitting surface but allows the normal contact areas of the user's body to have contact with the sitting surface. This is unlike a wedge type sitting devices that push a user's back away from the chair. The apparatuses 120 or 220 promote better posture by effecting the sacrum and coccyx at the posterior and effecting the anterior pubic ramus and medial thighs at the interior. The apparatuses 120 or 220 guide and support the sits bones and the thighs while allowing other anatomical structures, such as the urethra to exit out the anterior. Channel 146 is formed on a second side 148 of the sitting apparatus 120. The same for the second embodiment which has a channel 246 on a second side 248 of the sitting apparatus 220. The channel 146 or 246 is meant to accommodate and position the urethra of a male user of the devices. The channel 146 has an angle between fifty and seventy-five degrees or at least an angle steeper than an opposite side of the channel 146 side. Additionally, for male users, the apparatuses 120 and 220 can be used without the lids 124 and 224 respectively. Without the lids 124 and 224, the cavity 134 or 234 can accommodate the testicles of a male user, thus increasing the comfortability to the user. The lids 124 and 224 can be utilized for finger exercises by simply inverting the lid 124 or 224. The user pushes a top layer downward toward the adjacent layer.

In the preferred embodiment of 120 and 220, an angle between fifty and seventy-five degrees for the anterior pubis at the inferior pubic ramus and its transition into the ischium in relation to the second side 148 and 248 respectively. Conversely, the opposite side 158 and 258 is preferably at an angle of twenty to forty-five degrees for the sacrum and coccyx. The positioning of the device relative to the body parts described prevents the user from crossing the legs and makes the legs spread apart to a certain extent. The second lid 50 of the exercise apparatus 20 can be utilized as a sitting apparatus with the same benefits and measurements as described for the sitting apparatuses 120 and 220. While the preferred embodiment is two pieces, it is to be understood that a one piece embodiment could be utilized. Such a one piece embodiment would not either lack the lid or lack the ability to accommodate the testicles of a male user. Furthermore, the layers of 120 and 220 could be omitted and in lieu a solid piece of material could be utilized. Additionally, the apparatuses 120 or 220 can be convex or concave by the addition or removal of spacers (not shown).

A method of exercise comprises a variety of steps, each step utilizing the exercise apparatus 20 that elevates a portion of the user's body, specifically the lower back and buttocks. The method strengthens the muscles at and around the hip socket in all planes of motion. The exercise method works all of the muscles in the hip socket in all planes of motion wherein the user controls the resistance and the egronomical advantage of air allows the ball and socket joint at the hip to glide freely without the obstruction and binding motion that would be created by a mechanical device. The method can be accomplished with the user of the method placing his hands on his knees in one single position. Such placement of hands on the knees can accomplish a variety of body resistance exercises without selecting a different hand position. While any particular step can be the starting step, a variety of steps is achievable and can be accomplished with or without body resistance. A user of the apparatus and method should first try the steps without any body resistance and then proceed with body resistance. All steps described below are with a user on his back, with an upper portion of the user's back on a floor surface, a lower portion of the user's back on the sloped portion of the exercise apparatus and a top of the exercise apparatus. The lower portion is elevated approximately six to twelve inches above the upper portion of the back.

A first step wherein the knees are elevated and are closed together. The hands of the user are placed on the corresponding knee and provide the resistance for moving the applicable leg. The legs can be moved together or in the alternate in the first step.

A second step wherein the knees are apart from one another. The hands are placed in a similar position, knee, as in the first step. The user utilizes the body resistance in moving both knees or one knee towards the floor surface.

A third step wherein the knees are closed together with a hand on the corresponding anterior lateral portion of the knee. The user pulls one or both knees toward the user's chest.

A fourth step wherein the knees are apart from one another with the hands in the same position as in the third step. The user pulls one or both knees to provide resistance as the user attempts to bring one or both knees upward.

A fifth step wherein the knees are closed together with the corresponding hand on top of the knee such that the hand covers the knee. The user then attempts to pull at least one knee towards his chest while the user pushes in the opposite direction with his hand or hands.

A sixth step wherein the knees are apart from one another with the hands in the same position as in the firth step. The user then attempts to pull at least one knee toward the other while the user pulls in the other direction with his hand or hands.

A seventh step wherein the knees are apart from one another with the corresponding hand on the lateral part of the knee. The user then attempts to keep his knees apart while pushing on his knees with his hands while also flexing his abdomen thereby the knees being in proximity to the torso. This seventh step can also be done without flexing of the abdomen.

An eighth step wherein the knees are closed together with the corresponding hand on the medial portion of the knee. The user then attempts to pull the knees downward while pulling with hands for resistance to that downward movement. Like the seventh step, the movement can be done with or without flexing the abdomen.

A ninth step wherein the knees are apart with the opposite hand on the contralateral anterior portion of the knee. The user then attempts to push on the knees to maintain them apart.

A tenth step wherein the knees are apart with the opposite hand on the top of the knee. The user then attempt to pull on the knees to bring them together while providing a resistance force with the lower body.

An eleventh step wherein the knees are closed together with the corresponding hand on the ankle. The user then pulls with the hands downward while trying to push the lower legs upward. The user can do both legs at one time or in the alternative to simulate a weighted sprint.

A twelfth step wherein the knees are closed together with the corresponding hands on the back side of the ankle. The user then pushes upward with the hands while resisting in the opposite direction with the legs. The user can do both legs at one time or in the alternate to simulate a weighted sprint.

A thirteenth step wherein the knees are closed together, the legs fully extended, and the corresponding hand on the anterior thigh and knee. The user then pushes upward while trying to push in the opposite direction with the legs.

A fourteenth step wherein the knees are apart and the corresponding elbow on the lateral knee. The user then attempts to push the knees together while resisting with the legs.

A fifteenth step wherein the knees are apart and the corresponding elbow on the medial knee. The user then attempts to pull the knees further apart while resisting with the legs.

A sixteenth step wherein the knees are apart and the corresponding hand is on the lateral calf. The user then attempts to push the knees together while resisting with the legs.

A seventeenth step wherein the knees are apart and the corresponding hand on the medial calf. The user then attempts to pull the knees further apart while resisting with the legs.

An eighteenth step wherein the knees are apart, the bottom of the feet together and the corresponding hand on the ankle. The user then attempts to pull with the shoulders while resisting with the legs.

A nineteenth step wherein the knees are apart with the back of one ankle on the front of the other ankle, and the corresponding hand on the front of the knee. The user then attempts to pull the knee upward while resisting with the leg.

A twentieth step wherein the knees are together with the corresponding hand on the anterior thigh. The user then attempts to push the knees away from the torso while resisting with the legs. The user can do both legs at one time or in the alternate.

The foregoing description of the invention has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application to enable one skilled in the art to utilize the invention in various embodiments and with various modifications as are suited to the particular use contemplated. It is intended that the scope of the invention be defined by the claims appended hereto, and by their equivalents.

The invention claimed is:

1. An exercise apparatus used on a surface, comprising:

a main body;

the main body having at least one layer;

a lid;

the lid having at least one layer;

the main body comprising a cavity;

the cavity selectively housing a portion of the lid;

the main body comprises a base and a top;

the base has a larger surface area than a surface area of the top;

the lid has first end and a second end;

the first end has a larger surface area than a surface area of the second end;

the second end of the lid is selectively housed within the cavity;

the first end of the lid can be selectively placed on the top of the main body;

the first end of the lid covers the cavity entirely when the first end is placed on the top of the main body;
a first side of the main body forms an angle relative to the surface;
the angle between twenty and forty-five degrees;
the main body has a plurality of layers;
wherein air can move between the layers whereby a compression rate of the exercise apparatus can be changed;
the lid comprises a second cavity;
a second lid is selectively housed in the second cavity.

2. A sitting apparatus, comprising:
a main body;
the main body having an interior portion;
the interior portion having a shape;
the main body having at least one layer;
a lid;
the lid having at least one layer;
the lid having an exterior;
the exterior of the lid having a shape that is the inverse of the shape of the interior portion of the main body;
the main body comprising a cavity;
the cavity selectively housing the at least one layer of the lid;
the main body has multiple layers;
the lid has multiple layers;
the main body has a first side and a second side;
the second side has an angle between fifty and seventy-five degrees;
the first side has an angle between twenty and forty-five degrees.

3. The sitting apparatus of claim 2, wherein:
the main body comprises a base and a top;
the base has a larger surface area than a surface area of the top.

4. The sitting apparatus of claim 3, wherein:
the lid has first end and a second end;
the first end has a larger surface area than a surface area of the second end.

5. The sitting apparatus of claim 4, wherein:
the second end of the lid is selectively housed within the cavity.

6. An exercise apparatus used on a surface, comprising:
a main body;
the main body having at least one layer;
a lid;
the lid having at least one layer;
the main body comprising a cavity;
the cavity selectively housing a portion of the lid;
the lid is configured to have a shape that is the inverse of a shape of the cavity such that a portion of the lid is selectively housed in the cavity;
the main body has a first side and a second side;
the second side has an angle between fifty and seventy-five degrees;
the first side has an angle between twenty and forty-five degrees.

7. The exercise apparatus of claim 6, wherein:
the lid comprises a second cavity;
a second lid is selectively housed in the second cavity.

8. The exercise apparatus of claim 6, wherein:
substantially all of the lid is selectively housed in the cavity.

9. The exercise apparatus of claim 8, wherein:
the lid can be inverted and placed on the base.

10. A sitting apparatus, comprising:
a main body;
the main body having an interior portion;
the interior portion having a shape;
the main body having at least one layer;
a lid;
the lid having at least one layer;
the lid having an exterior;
the exterior of the lid having a shape that is the inverse of the shape of the interior portion of the main body;
the main body comprising a cavity;
the cavity selectively housing the at least one layer of the lid;
the main body has a first side and a second side;
the second side has an angle between fifty and seventy-five degrees;
the first side has an angle between twenty and forty-five degrees.

11. An exercise apparatus used on a surface, comprising:
a main body;
the main body having at least one layer;
a lid;
the lid having at least one layer;
the main body comprising a cavity;
the cavity selectively housing a portion of the lid;
the main body comprises a base and a top;
the base has a larger surface area than a surface area of the top;
the lid has a first end and a second end;
the first end has a larger surface area than a surface area of the second end;
the second end of the lid is selectively housed within the cavity;
the first end of the lid can be selectively placed on the top of the main body;
the first end of the lid covers the cavity entirely when the first end is placed on the top of the main body;
the main body has a first side and a second side;
the second side has an angle between fifty and seventy-five degrees.

12. The exercise apparatus of claim 11, further comprising:
air channels;
the air channels allowing air flow.

13. An exercise apparatus used on a surface, comprising:
a main body;
the main body having at least one layer;
a lid;
the lid having at least one layer;
the main body comprising a cavity;
the cavity selectively housing a portion of the lid;
the main body comprises a base and a top;
the base has a larger surface area than a surface area of the top;
the lid has a first end and a second end;
the first end has a larger surface area than a surface area of the second end;
the second end of the lid is selectively housed within the cavity;
the first end of the lid can be selectively placed on the top of the main body;
the first end of the lid covers the cavity entirely when the first end is placed on the top of the main body;
the lid comprises a second cavity;
a second lid is selectively housed in the second cavity.

14. The sitting apparatus of claim 2, wherein:

the second side of the main body has a channel configured to position the urethra of a male user of the sitting apparatus.

* * * * *